United States Patent [19]

Koba

[11] Patent Number: 4,850,404

[45] Date of Patent: Jul. 25, 1989

[54] VENEER TENDERIZING DEVICE

[75] Inventor: Yoshinori Koba, Obu, Japan

[73] Assignee: Meinan Machinery Works, Inc., Obu, Japan

[21] Appl. No.: 229,921

[22] Filed: Aug. 8, 1988

[30] Foreign Application Priority Data

Aug. 13, 1987 [JP] Japan ..... 62-202304

[51] Int. Cl.[4] ..... B27M 1/02; B27M 3/00

[52] U.S. Cl. ..... 144/2 R; 29/121.6; 100/121; 144/362

[58] Field of Search ..... 144/2 R, 209.2, 361, 144/362, 213; 29/121.6; 100/121

[56] References Cited

U.S. PATENT DOCUMENTS

| | | | |
|---|---|---|---|
| 4,137,956 | 2/1979 | Toberg | 144/2 J |
| 4,219,060 | 8/1980 | Hasegawa | 144/213 R |
| 4,318,433 | 3/1982 | Amundsen | 144/2 J |
| 4,655,869 | 4/1987 | Tellman et al. | 144/2 J |
| 4,718,338 | 1/1988 | Koba | 144/362 |
| 4,796,680 | 1/1989 | Koda | 144/362 X |

*Primary Examiner*—W. Donald Bray

*Attorney, Agent, or Firm*—Brooks Haidt Haffner & Delahunty

[57] ABSTRACT

A device is disclosed which is adapted to tenderize wood veneer sheet by feeding such sheet into the nip between a pair of rotating rolls at least one of which rolls has on the periphery thereof a number of projections arranged to incise the sheet for forming therein checks along the direction of grain orientation of the wood veneer sheet. Each projection on the roll has a pointed distal tip end and a proximal broad base, and at least the portion of the projection adjacent the distal tip end thereof is of a pyramidal shape having a vertex corresponding to said distal tip end and N sides, wherein N stands for an even number of more than two, with said sides intersecting to define edges of said pyramidal shape between any two adjoining such sides. The pyramidal shape for the projection includes a pair of opposite edges extending in opposite directions from said vertex and so oriented that a phantom plane containing such opposite edges is parallel to a straight phantom line drawn on the peripheral surface of said one roll in parallel to the axis thereof.

5 Claims, 5 Drawing Sheets

VENEER TENDERIZING DEVICE

FIELD OF THE INVENTION

The present invention relates generally to a device for tenderizing wood veneer sheet by feeding such sheet into the nip between a pair of rotating rolls at least one of which rolls has on the periphery thereof a number of projections arranged to incise the sheet for forming therein checks along the direction of grain orientation of the wood veneer sheet. More specifically, it relates to a geometrical shape of each such projection on the tenderizing roll which can permit successful check formation even in the veneer sheet cut from a log having varying grain orientations.

BACKGROUND OF THE INVENTION

It is generally known that a veneer sheet produced, e.g., by peeling tends to be curled or become wavy and such curling and waviness make it troublesome to handle the sheets. It is thus desirable to make the sheet substantially flat by a process known as tenderizing by which a number of checks, or small cracks, are formed in the veneer sheet by incising the same with cutting means such as blades so as to wedge the veneer apart in the direction perpendicular to the veneer grain or fiber orientation. It is also known that the tenderizing of wood veneer sheet has many other helpful advantages such as expansion of the sheet in the direction perpendicular to the grain, hence an increase in the veneer yield, faster drying due to easier flow of hot air through the tenderized sheet, thereby saving the cost in veneer drying, etc.

A veneer sheet tenderizing device of a well known type comprises a pair of rolls spaced so as to form a nip therebetween through which a veneer sheet is fed with its grain directed substantially perpendicular to the direction in which the sheet is fed. At least one of the nip rolls has on its periphery a number of projections the distal ends of which are defined by an edge having a given length and extending substantially in parallel to the grain of veneer sheet being fed into the nip and the edge is adapted to wedge the wood apart across the grain thereby to form checks in the sheet in the grain direction.

The checks can be formed successfully if the grain orientation coincides with, or angularly offset only slightly, e.g. at about 8 degrees, from, the extending direction of the projection edge. However, if an angle of the grain orientation with respect to the extending direction of the edge is greater, e.g. at about 10 degrees, the veneer sheet at the point of engagement with the edge is only crushed without being wedged apart and, as a result, the desired tenderizing effect cannot be achieved. Such poor tenderizing effect is noticeable particularly in such veneer sheets that are peeled from a block of low grade having its wood grain running in various directions, e.g. a peeler block available from part of a log which is relatively close to the root portion of a tree and therefore has a tangle of wood fibers extending in varying directions. If a poorly tenderized veneer sheet is dried, it will be warped to such an extent that makes the sheet unusable.

A tenderizing device designed in an attempt to solve the above problem has been proposed by the Publication of Examined Japanese Utility Model Application No. 50-34312 (1975), wherein its tenderizing roll has formed on the periphery thereof a number of projections disposed at regular intervals along a plurality of zigzag lines each extending generally in the axial direction of the roll with alternating angles and spaced from each other at regular intervals in the circumferential direction. The distal end of each projection is defined by a straight edge having a given length and oriented in alignment with a straight line section of the zigzag line, so that the projections are formed with two different inclinations for their straight edges with respect to the roll axis.

With use of such a tenderizing roll, checks can be formed satisfactorily where the grain direction happens to substantially coincide with the inclination of the projection edges, while such checks cannot be produced where an angle between the edge inclination and the grain direction is large.

SUMMARY OF THE INVENTION

Therefore, it is an object of the present invention to provide a wood veneer tenderizing device which can permit uniform formation of checks even in the veneer sheet having varying grain orientations so as to achieve the desired tenderizing effect.

The tenderizing device of the present invention comprises a pair of rotatable roll members which are arranged so as to form a nip between the peripheries thereof and at least one of which has on the periphery thereof a number of projections each having a pointed distal tip end and a proximal broad base, and means for feeding a veneer sheet into the nip. At least the portion of each projection which is adjacent the distal tip end thereof is of a pyramidal shape having a vertex corresponding to the above distal tip end and N sides, wherein N stands for an even number of more than two, e.g. four, defining an edge of the above pyramidal shape between any two adjoining such sides.

In a preferred embodiment of the invention, the pyramidal shape is a quadrilateral pyramid having four sides and four edges, and a pair of opposite edges extending in opposite directions from said vertex are so oriented that a phantom plane containing such opposite edges may be parallel to a phantom straight line drawn on the peripheral surface of said one roll member in parallel to the axis thereof. The angle which is formed by and between any two opposite sides of the quadrilateral pyramid is between about 40 and 90 degrees, preferably about 60 degrees.

In operation of this tenderizing device, the projection pressed into a wood veneer sheet can have any two of the opposite sides of its pyramidal shape to work as a wedge to separate the veneer fibers thereacross successfully even if the grain orientation at the point of engagement with the projection is inclined with respect to, e.g., the aforementioned phantom straight line in parallel to the axis thereof.

In another embodiment of the invention, the other roll member is clad with a material having a relatively high frictional coefficient and the roll with the projections is driven faster in surface speed than the clad roll, so that part of the veneer sheet in the nip is subjected to tension acting to widen the checks formed by the projections, thereby causing the veneer sheet to be expanded in the direction across the veneer grain.

The above and other objects, features and advantages of the invention will become apparent to those skilled in the art from the following description of the preferred embodiments of veneer tenderizing apparatus according to the present invention, which description is made with reference to the accompanying drawings, wherein:

DETAILED DESCRIPTION OF THE PREFERRED EMBODIMENT

Figure 1:
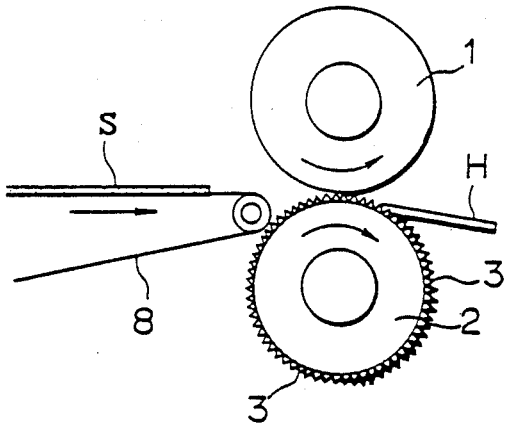
FIG. 1 is a schematic side view showing a tenderizing device having a pair of nip rolls one of which has on the periphery thereof a number of projections formed according to the present invention.

Referring to FIG. 1 showing a tenderizing device according to the present invention, it comprises a pair of upper and lower rolls 1 and 2 driven in the arrow directions by any suitable drive mean (not shown) and a conveyer 8 for moving a veneer sheet S toward the nip between the two rolls. Though not shown clearly, the veneer sheet S in FIG. 1 is moved with the general orientation of its grain directed across the direction in which it is moved toward the rolls. The upper roll 1 is clad on the entire periphery thereof with resilient material such as urethane rubber, while the roll 2 is made of a rigid material such as steel and formed on the periphery thereof with a number of projections 3. The rolls 1 and 2 are spaced from each other so that the space at the nip therebetween may be at least smaller than the thickness of the veneer sheet S and hence the sheet fed into the nip be pressed by the rolls 1 against the projections 3 on the roll 2. Incidentally, the space in the illustrated embodiment of FIG. 1 is set substantially zero. The reference symbol H designates means for separating veneer sheet from the projections 3 on the roll 2 while guiding the same downstream. Though not shown clearly in FIG. 1, the separating means is shaped, as viewed from the top, like a comb having a plurality of blades extending toward the roll 2.

Figure 4:
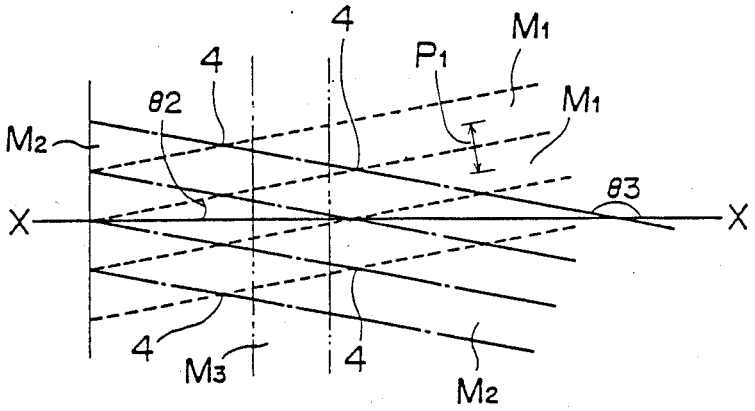
FIG. 4 is an illustrative view showing a manner of forming the projections on the one roll of FIG. 1.

For the purpose of aiding in understanding of the shape of the projection 3 for handling veneer sheets with a thickness of, e.g., 3.2 mm, a method of forming such projections will be explained in the following with reference to FIG. 4 showing part of the peripheral surface of a steel cylindrical block which is to be reduced to the tenderizing roll 2.

The block has a diameter of, e.g., 300 mm, and the line X—X in FIG. 4 represents a straight phantom line on the peripheral surface of the cylindrical block parallel to its axis. Using a cutting tool having an angle $\theta 1$, e.g. 60 degrees, at the peripheral edge, a series of spiral angular grooves M1, as defined by any two adjacent dotted lines, are formed at an inclination angle of about, e.g., 10 degrees with respect to the line X—X, as indicated by $\theta 2$. The grooves M1 are formed on the entire periphery of the block at intervals of about 8 mm, as indicated by P1, and with a depth of about 6.9 mm so that a spiral edge formed between any two adjacent grooves M1 and indicated by dotted line may substantially correspond to the original peripheral surface of the cylindrical block.

Incidentally, each groove M1 can be formed, e.g., by feeding the cylindrical block in the axial direction while rotating the same on its axis at a given rate in connection with the rate at which it is axially fed so that an angle of about 10 degrees may be achieved for the angle $\theta 2$.

Figure 3A:
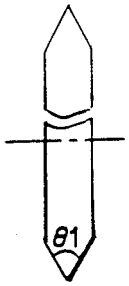
FIG. 3*a* is a side view of a cutting tool for forming an angled groove.

Using the same cutting tool of FIG. 3*a*, another series of spiral angular grooves M2, as defined between any two adjacent dash-and-dot lines, are cut in the periphery of the cylindrical block in the same manner as in the cutting of the grooves M1, but at an inclination angle of about 170 degrees, as indicated by $\theta 3$, so that the grooves M1 and M2 may be symmetrical with respect to the line X—X.

Figure 2:
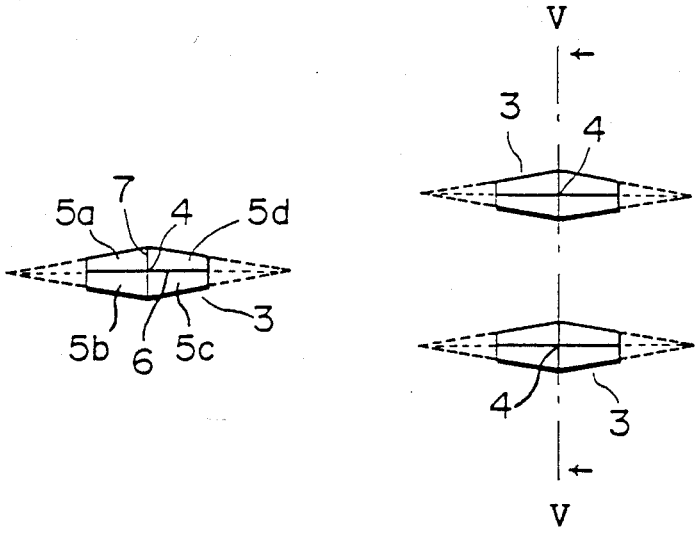
FIG. 2 is an enlarged partial view on the periphery of the one roll of FIG. 1, showing the arrangement and geometric shape of the projections, only three being shown.

In thus cutting the symmetrical spiral grooves M1 and M2 throughout the periphery of the cylindrical block, a number of projections are formed in the shape of a quadrilateral pyramid as shown by both solid and dotted lines in FIG. 2 and in the arrangement as partially shown in the same drawing. As could be understood, the vertex 4 of each quadrilaterally pyramidal projection corresponds to an intersecting point formed by the dashed and dash-and-dot lines in FIG. 4.

Figure 3B:
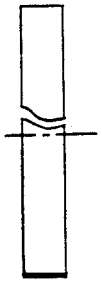
FIG. 3*b* is a side view of a cutting tool for forming a plain groove.

Then, using a cutting tool having a plain cutting edge as shown in FIG. 3*b*, a plurality of circumferential plain grooves, as exemplified by M3 defined between two dash-and-two-dot lines in FIG. 4, are formed substantially throughout the length of the cylindrical blocks. Each groove M3 should be cut with sufficient width and depth to receive therein each blade of the comb-shaped separating means. In the illustrated embodiment, the groove is formed with a width of about 17 mm, so that the opposite ends of each quadrilaterally pyramidal projection, as indicated by dotted line in FIG. 2, are cut off thereby to ultimately form a projection 3 shown by solid lines in the same drawing.

Each of the projections 3 thus formed on the roll 2 is shaped as part of a quadrilateral pyramid, having a vertex 4, four sides 5*a*, 5*b*, 5*c*, 5*d*, two long edges 6 and two short edges 7, and so positioned that a phantom plane containing two long edges 6 of each projection 3 may be parallel to the line X—X, the lines connecting the vertices 4 of the projections 3 along the grooves M1 and M2 describe spiral lines forming an angle of 10 or 170 degrees with respect to the line X—X, and also that the vertices 4 of a series of projections 3 arranged circumferentially of the roll 2 be positioned on a phantom circle defined by the peripheral circumference of the original cylindrical block.

Figure 5:
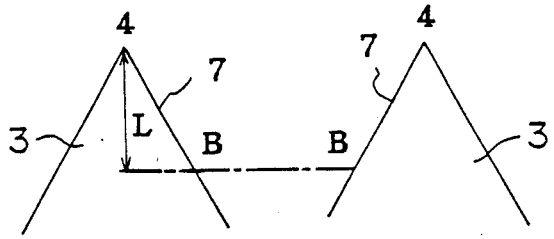
FIG. 5 is schematic sectional view taken along the line V—V of FIG. 2, showing the upper portion of two adjacent projections.

Referring to FIG. 5 showing upper portions of two adjacent projections 3 in cross-section along the line V—V of FIG. 2, line B—B is drawn between the shorter edges 7 of the two projections 3 in parallel to the line connecting the vertices 4, 4 and at a distance L equal to the thickness of the veneer sheet S, or 3.2 mm, from the line 4—4. In the formation of the projections 3, the distance B—B should be greater than the distance L. As it would be understood by those skilled in the art, thus forming the projctions 3 in relation to the veneer sheet thickness prevents reduction in thickness of veneer sheet which may be caused otherwise in the subsequent drying process. Since such formation of the projections 3 constitutes no part of the present invention, no further description of the reason is given herein.

In operation, the veneer sheet S is fed by the conveyer 8 toward the nip between the rolls 1 and 2 with the general orientation of its grain across the direction in which the sheet is moved for feeding. The sheet S moved into the nip is pressed by the upper roll 1 against the pyramidal projections 3 on the lower roll 2. Thus, the projections 3 incise the sheet S from its underside to wedge the wood fibers of veneer apart across the grain direction, thereby forming checks in the veneer sheet.

Figure 6:
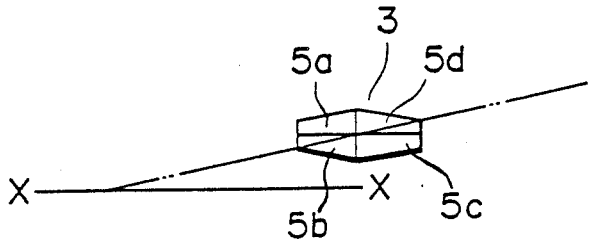
FIGS. 6 and 7 are illustrative views showing the wedging action of the projection on veneer sheet when its grain is directed at different inclinations with respect to the axis of the tenderizing roll.
Figure 7:
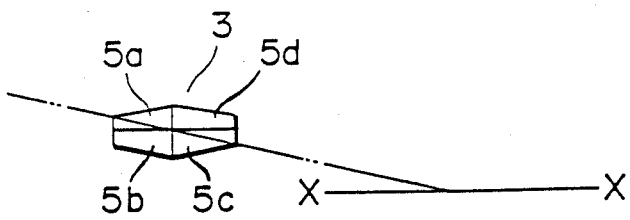

The wedging action of the pyramidal projection 3 on a veneer sheet having varying gain orientations is illustrated in FIGS. 6 and 7. Referring firstly to FIG. 6 wherein a grain orientation of the veneer sheet is indicated by a phantom line which is inclined at about 10 degree with respect to the aforementioned line X—X, the projection 3 pressed into the veneer sheet acts to separate its wood fibers apart across the grain by the action then effected by a wedge formed by the sides 5*a* and 5*c* of the pyramidal projection 3. Thus, a check necessary for the desired tenderizing effect can be formed properly along the grain direction. In this case, the wedging action by the sides 5*a* and 5*c* can be effective to a grain direction inclined by about 8 degrees in either direction from the shown phantom line. In these grain directions relative to the projection 3, the sides 5*b* and 5*d* make no contribution to the wedging action.

In FIG. 7 wherein the wood grain direction is inclined in substantially symmetrical relation to that of FIG. 6 with respect to the line X—X, or inclined at an angle of about 170 degrees with respect to the line X—X, the projection 3 pierced into the veneer sheet acts to separate the fibers apart across the grain by the action effected by a wedge then formed by the sides 5*b* and 5*d* of the pyramidal projection 3. The wedging action by the sides 5*b* and 5*d* can work effectively even if the grain direction is inclined by about 8 degrees in either direction from the shown inclination. In these grain directions, the sides 5*a* and 5*c* do not contribute to the wedging action to separate the wood fibers apart across the grain.

The veneer sheet thus formed with tenderizing checks is moved out of the nip between the rolls 1 and 2 and then guided downstream while being separated from the projections 3 by the comb-shaped separating means H.

In this way, the projections 3 on the roll 2 working in conjunction with the roll 1 can make possible formation of tenderizing checks in a veneer sheet having a grain direction inclined at, e.g., about 10 or 170 degrees with respect to the line X—X. Since each projection 3 can act to wedge apart the veneer fibers oriented in varying directions in a single sheet of veneer, a veneer sheet having a complicated pattern of wood grain can be tenderized uniformly on the entire surface.

Figure 8:
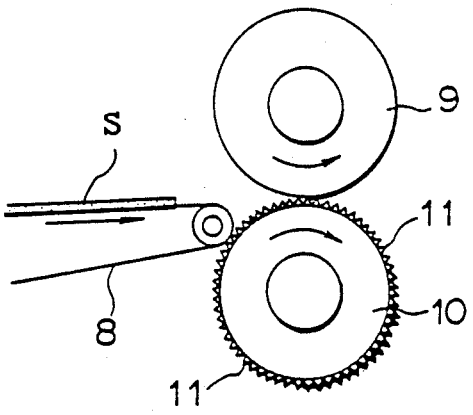
FIG. 8 is a view similar to FIG. 1, but showing another embodiment of veneer tenderizing device.
Figure 9:
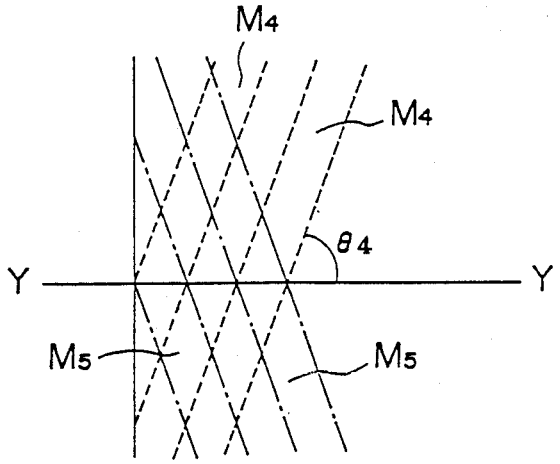
FIG. 9 is an illustrative view showing a method of forming projections on one of the nip rolls of FIG. 8.
Figure 10:
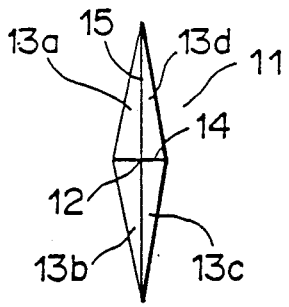
FIG. 10 shows a projection formed on the periphery of the one roll of FIG. 8 by the method of FIG. 9.

The following will describe a second embodiment of the invention with reference to FIGS. 8, 9 and 10.

Referring firstly to FIG. 8, the tenderizing device comprises a pair of rolls 9 and 10 driven in the arrow directions and conveyer 8 for feeding a veneer sheet toward the rolls. The roll 10 is formed on its periphery with a number of projections 11 in the form of a quadrilateral pyramid as shown in FIG. 10. The rolls 9 and 10 are spaced from each other in the same relation as in the first embodiment.

The quadrilaterally pyramidal projections 11 can be formed on the same cylindrical block as that used in the first embodiment by cutting with use of the cutting tool of FIG. 3*a* a series of spiral angular grooves M4 (FIG. 9) as defined by any two adjacent dotted lines at an angle of about 70 degrees with respect to the line Y—Y, as indicated by $\theta$4. The line Y—Y, like the line X—X in the first embodiment, represents a straight phantom line on the peripheral surface of the cylindrical block parallel to its axis. The grooves M4 are formed on the entire periphery of the block at intervals of about 8 mm and with a depth of about 6.9 mm. Using the same cutting tool, another series of spiral angular grooves M5, as defined between any two adjacent dash-and-dot lines, are cut in the periphery of the cylindrical block in the same manner as in the cutting of the above grooves M4, but at such an angle that the grooves M4 and M5 may be symmetrical with respect to the line Y—Y.

Each of the projections 11 thus formed on the tenderizing roll 10 is shaped as a quadrilateral pyramid having a vertex 12, four sides 13*a*, 13*b*, 13*c*, 13*d*, two short edges 14 and two long edges 15, as shown in FIG. 10, and positioned such that a phantom plane containing two short edges 14 is parallel to the line Y—Y. Furthermore, it is so arranged that the lines connecting the vertices 12 of the projections 11 of each series along the grooves M4 or M5 describe spiral lines forming an angle of 70 or 110 degrees with respect to the line Y—Y, and also that the vertices 12 of the projections 11 arranged circumferentially of the roll 10 are positioned on a phantom circle defined by the peripheral circumference of the original cylindrical block.

In addition to the grooves M4 and M5, a circumferential groove (not shown) is formed with use of the cutting tool of FIG. 3*b*, between each two adjacent circumferential rows of projections 11 with a depth large enough to receive therein each blade of a comb-shaped means (not shown) for separating the veneer sheet from the projections.

Operation of the tenderizing device of this second embodiment is substantially the same as that in the first embodiment, but differs only in that the veneer sheet S is fed by the conveyer 8 toward the nip between the rolls 9 and 10 with the general orientation of its grain in parallel to the direction in which the sheet is fed. Since the arrangement of the projections 11 relative to the above grain orientation of veneer sheet to be processed is the same, detailed description on the wedging action of the projection 11 on the veneer sheet is omitted.

Figure 11:
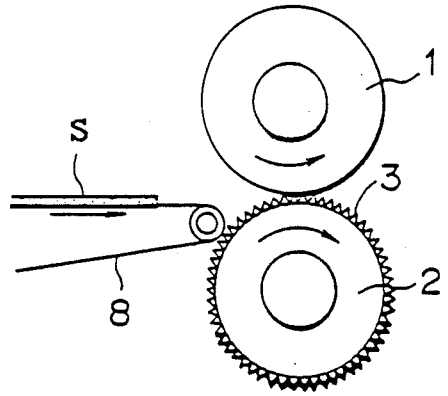
FIG. 11 is a view similar to FIG. 1, but showing still another embodiment of veneer tenderizing device.
Figure 12:
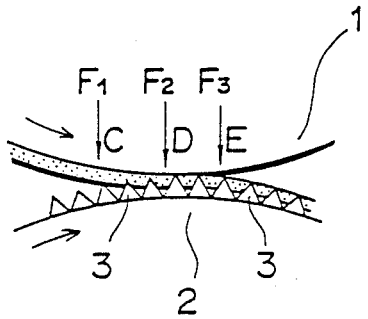
FIG. 12 is an enlarged view of FIG. 11, showing the nip between the two rolls.

Now referring to FIGS. 11 and 12 showing a third embodiment, the arrangement in FIG. 11 is substantially the same as that of FIG. 1, but differs in that the rolls 1 and 2 are driven through gearing so that the roll 2 is driven faster in surface speed than the roll 1, e.g. by about 20 percent.

In FIG. 12 showing the nip between the rolls 1 and 2 in an enlarged view, the reference symbol D represents the center of the nip, and C and E designate positions adjacent the entrance and exit of the nip, respectively. The references F followed by numerals 1, 2 and 3 represent the forces exerted to the veneer sheet S at the above positions C, D and E, respectively, by the urethane rubber clad roll 1.

The force F1 which acts to press the veneer sheet S against the projection 3 is greater than the respective forces F2 and F3 which act on the sheet where it has been incised by the projections 3. Therefore, the frictional force of the roll 1 acting on the veneer sheet S at position C is greater than those at positions D and E.

Reference being had then to the relationship between the veneer sheet S and the tenderizing roll 2, the sheet at position C is just about to be incised by the projection 3, while it has been incised at positions D and E. Therefore, the veneer sheet S is subjected to frictional force of the projection 3 at position C and to shearing force thereof at positions D and E.

As it would be now understood, the veneer sheet S at position C where it is subjected to frictional force on opposite sides is forced to move at a speed substantially equal to the surface speed of the roll 1 because it is clad with rubber having, with respect to the surface of the veneer sheet, a higher frictional coefficient than the steel roll 2. On the other hand, the veneer sheet S at positions D and E receives frictional force from the roll 1 and shearing force from the roll 2. Because the shearing force acts on the veneer sheet S greater than the frictional force, the sheet at D and E is force to move at a speed corresponding to the surface speed of the roll 2. As a result, the veneer sheet S is subjected to tension at a portion thereof between positions C and D, acting to widen the checks formed by the projections 3, thus causing the veneer sheet S to be expanded in the direction across the veneer grain.

Though the invention has been described and illustrated with reference to the specific embodiments, it is to be understood that the invention can be changed or modified without departing from the spirit or scope thereof, as exemplified below.

In the above-described embodiments, the angle of the projection, e.g. 3 in the first embodiment, formed by opposite sides, e.g. 5*a* and 5*c* or 5*b* and 5*d*, is disclosed as 60 degrees. If this angle is less than about 30 degrees, the projection only incises the sheet without forming the desired checks; if it is more than about 100 degrees, the projection only presses and crushes the veneer sheet surface. For permitting formation of the desired checks, the angle should be between about 40 and 90 degrees.

Though the interval, e.g. P in the first embodiment, at which the spiral grooves, e.g. M1, are to be formed, has been set at 8 mm, this may be changed as required, preferably between about 4 and 10 mm, in connection with the angle of the projection vertex and the depth of the grooves.

Regarding the projection, the invention is not intended to limit its shape only to those shown in the above embodiments, but it may be formed, e.g., such that at least the outer portion thereof may be of a pyramidal shape having six sides. The provision of such projections can cope with veneer sheet having more complicated grain patterns.

Furthermore, the angle, e.g., made between the spiral groove M1 and the line X—X as in the first embodiment, may be selected between about 10 and 25 degrees.

Though in the illustrated embodiments the projections are formed integrally by cutting grooves on the periphery of a cylindrical block, they may be manufactured independently of the block and then inserted in their mating recesses formed in the block periphery.

What is claimed is:

1. A device for tenderizing a wood veneer sheet by wedging the wood apart across the grain direction of the veneer sheet to form checks therein, said device comprising a pair of roll members mounted for rotation about parallel axes spaced apart to form a nip between the peripheries of the roll members, and means for feeding the veneer sheet into said nip with the general orientation of its grain perpendicular to the direction in which the sheet is fed into said nip, at least one of said roll members having on the periphery thereof a number of projections each having a pointed distal tip end and a proximal broad base, at least the portion of each of said projections which is adjacent the distal tip end thereof being of a pyramidal shape having a vertex corresponding to said distal tip end and N sides, wherein N stands for an even number of more than two, with said sides that adjoin intersecting to define edges of said pyramidal shape that extend in pairs in opposite directions from said vertex, said projections being oriented so that one of said pairs of edges lies in a phantom plane that is substantially parallel to a straight phantom line on the peripheral surface of said one roll member in parallel to the axis thereof.

2. A device according to claim 1, wherein said pyramidal shape is a quadrilateral pyramid having four sides and four edges each defined between any two adjoining sides.

3. A device according to claim 2, wherein said quadrilateral pyramid is so shaped that each two opposite sides thereof forms therebetween an angle between 40 and 90 degrees.

4. A device according to claim 1, wherein at least the peripheral surface of the other roll member of said pair is made of a material having with respect to the surface of the veneer sheet a frictional coefficient higher than that of the peripheral surface of said one roll member, and the latter one roll member is rotatable at a higher surface speed than the former other roll member.

5. A device for tenderizing a wood veneer sheet by wedging the wood apart across the grain direction of the veneer sheet to form checks therein, said device comprising a pair of roll members mounted for rotation about parallel axes spaced apart to form a nip between the peripheries of the roll members, and means for feeding the veneer sheet into said nip with the general orientation of its grain parallel to the direction in which the sheet is fed into said nip, at least one of said roll members having on the periphery thereof a number of projections each having a pointed distal tip end and a proximal broad base, at least the portion of each of said projections which is adjacent the distal tip end thereof being of a pyramidal shape having a vertex corresponding to said distal tip end and N sides, wherein N stands for an even number of more than two, with said sides that adjoin intersecting to define edges of said pyramidal shape that extend in pairs in opposite directions from said vertex, said projections being oriented so that one of said pairs of edges lies in a phantom plane that is substantially perpendicular to the axis of said one roll member.

* * * * *